US006135785A

United States Patent [19]

Niitsu

[11] Patent Number: 6,135,785

[45] **Date of Patent: *Oct. 24, 2000**

[54] SMALL PITCH ELECTRICAL CONNECTOR HAVING NARROWED PORTION

[75] Inventor: Toshihiro Niitsu, Yokohama, Japan

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/811,655

[22] Filed: Mar. 5, 1997

[30] Foreign Application Priority Data

Mar. 14, 1996 [JP] Japan ..... 8-085734

[51] Int. Cl.[7] ..... H01R 9/09

[52] U.S. Cl. ..... 439/74; 439/862

[58] Field of Search ..... 439/74, 660, 862, 439/495, 733.1

[56] References Cited

U.S. PATENT DOCUMENTS

| | | | |
|---|---|---|---|
| 4,778,231 | 10/1988 | Seidler et al. | 439/862 |
| 4,955,820 | 9/1990 | Yamada et al. | 439/83 |
| 4,990,107 | 2/1991 | Fortuna | 439/637 |
| 5,082,459 | 1/1992 | Billman et al. | 439/637 |
| 5,100,337 | 3/1992 | Chao | 439/326 |
| 5,116,247 | 5/1992 | Enomoto et al. | 439/660 |
| 5,199,895 | 4/1993 | Chang | 439/326 |
| 5,249,988 | 10/1993 | Lu | 439/751 |
| 5,254,017 | 10/1993 | Tondreault et al. | 439/637 |
| 5,259,793 | 11/1993 | Yamada et al. | 439/637 |
| 5,259,795 | 11/1993 | Yamada et al. | 439/751 |
| 5,263,870 | 11/1993 | Billman et al. | 439/108 |
| 5,308,252 | 5/1994 | Mroczkowski et al. | 439/66 |
| 5,316,496 | 5/1994 | Imai | 439/495 |
| 5,387,133 | 2/1995 | Tondreault et al. | 439/862 |
| 5,393,234 | 2/1995 | Yamada et al. | 439/62 |
| 5,403,215 | 4/1995 | Buchter et al. | 439/733.1 |
| 5,437,556 | 8/1995 | Bargain et al. | 439/66 |
| 5,480,316 | 1/1996 | Kinross et al. | 439/326 |
| 5,498,167 | 3/1996 | Seto et al. | 439/74 |
| 5,620,342 | 4/1997 | Kinross | 439/637 |
| 5,626,487 | 5/1997 | Cheng et al. | 439/326 |

*Primary Examiner*—Neil Abrams
*Assistant Examiner*—Barry M. L. Standig
*Attorney, Agent, or Firm*—Charles S. Cohen

[57] ABSTRACT

An electrical connector for mating with a complementary component includes an insulative housing having a receptacle for receiving a portion of the complementary component and a plurality of terminal receiving cavities for receiving terminals therein. A plurality of generally planar conductive terminals are stamped from sheet metal material of a predetermined thickness, with each terminal having a predetermined thickness generally equal to the thickness of the sheet metal material from which it is stamped. Each of the terminals is mounted in one of the cavities. The terminals include a generally rigid base having a base width parallel to the plane of the terminal, a solder tail extending from the base, a retention section for securing the terminal within the housing and an L-shaped contact portion extending from the base. The L-shaped contact portion include first and second legs connected at a juncture portion. The first leg has a first width parallel to the plane of the terminal and includes a contact portion for contacting a conductive portion of said the complementary component. The second leg extends from said base and the juncture portion has a juncture width parallel to the plane of the terminal. The base width and the first width being greater than the thickness of the terminal and the juncture width being less than the thickness of the terminal.

11 Claims, 5 Drawing Sheets

SMALL PITCH ELECTRICAL CONNECTOR HAVING NARROWED PORTION

FIELD OF THE INVENTION

This invention generally relates to the art of electrical connectors and, particularly, to a terminal for an electrical connector, the terminal being stamped of sheet metal material.

BACKGROUND OF THE INVENTION

A variety of electrical connectors have been used to make electrical connections between the circuits on different printed circuit boards. In board-to-board connectors, male and female terminals form an electrical connection between the two circuit boards. Male connector posts or pins typically are coupled to a first circuit board, and the male connector posts mate with female connector terminals coupled to the second circuit board. In some connectors, the terminals may be hermaphroditic and include both male and female portions.

Terminals for such connectors typically are stamped out of thin sheet metal material, and the terminals are fixed in an elongated insulating housing at regular intervals longitudinally thereof. Each terminal includes a contact beam, arm or post for contacting a complementary terminal in the associated mating connector housing. Typically, the contact arm is cantilevered from a base which is integral with the contact arm and which is fixed to the connector housing. A retention arm also might extend from the base for rigidly retaining the terminal in the housing. The contact arm of the terminal preferably is sufficiently flexibly rigid to facilitate a positive engagement and disengagement with the complementary terminal of the mating connector, but the flexible contact arms of all of the terminals in the connector must not be too rigid so as to require an excessive force when mating and unmating the connectors. The flexibility of the contact arm can be increased by increasing the length of the arm or reducing the width of the arm measured in the plane of the sheet metal material.

Problems have been encountered with these types of electrical connector systems because there is an ever-increasing demand for higher density connectors and for allowing printed circuit boards to be placed closer together. High density connectors often reduce the spacing between the terminals of a given connector, but the thickness of the terminals cannot be manipulated beyond given parameters. To allow printed circuit boards to be placed closer together in parallel planes, a very low profile connector is required which, in turn, limits the length of the contact arms of the terminals.

A corollary problem arises when the spacing between the terminals is reduced to increase the density of the connectors. Since the thickness of the sheet metal material of the terminals cannot be reduced beyond practical limits, there is an increasing probability that the flexible contact arm of any given terminal might engage a complementary terminal of the mating connector which is on one or the other side of the given terminal instead of the correct complementary terminal with which the given terminal is intended to engage.

The present invention is directed to solving these various problems by providing improvements in the electrical terminals of electrical connectors of the character described.

SUMMARY OF THE INVENTION

An object, therefore, of the invention is to provide a new and improved electrical terminal for use in a circuit board mounted electrical connector requiring a fine pitch for board interconnections.

In the exemplary embodiment of the invention, the electrical terminal is adapted for contacting one of a plurality of closely spaced terminal blades of a complementary mating terminal. The terminal is generally U-shaped and includes a generally rigid retention arm and a flexible contact arm joined to the retention arm by a generally rigid base. The contact arm has a given thickness in a direction generally perpendicular to the plane of the U-shaped terminal, and a contact portion projects from the contact arm toward the retention arm for engaging the one terminal blade. The sides of the contact arm at the projecting contact portion are stepped so that the thickness of the contact portion is less than the given thickness of the contact arm.

The electrical terminal is stamped of sheet metal material to define sides and edges. Generally, the flexible contact arm is cantilevered from the rigid base, and a juncture portion joins the contact arm to the base. The width of the contact arm between its edges near the contact portion is greater than the width of the juncture portion. The width of the base between its edges is greater than the width of the juncture portion.

Furthermore, the terminal has a given thickness between its sides. The invention contemplates that the width of the contact arm between its edges is greater than the given thickness. The width of the base between its edges is greater than the given thickness. The width of the juncture portion between its edges is less than the given thickness.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
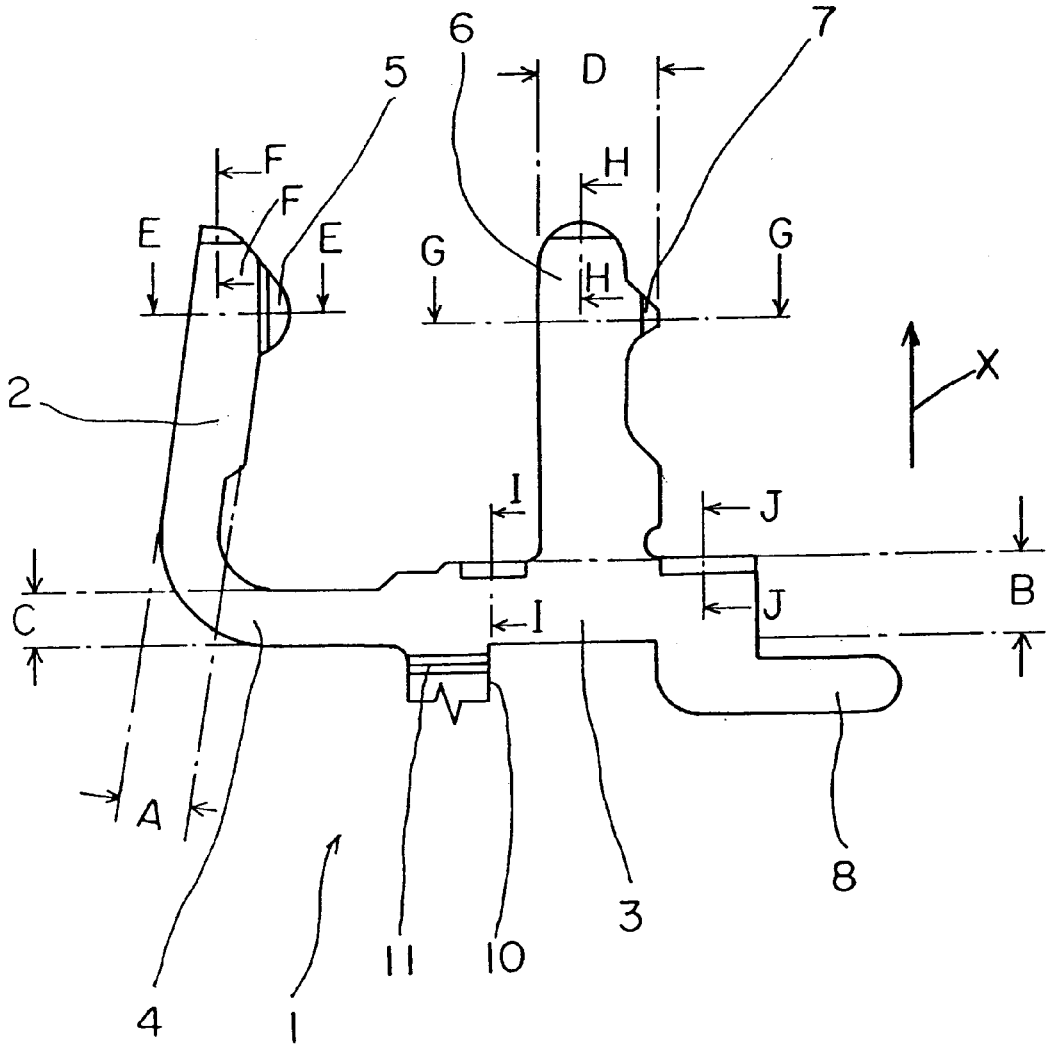
FIG. 1 is a side elevational view of the electrical terminal according to the present invention.

Referring to the drawings in greater detail, and first to FIG. 1, an electrical terminal, generally designated 1, is stamped or blanked out of thin sheet metal material, and a plurality of such terminals are arranged at regular intervals in a generally parallel array along an insulating housing 12 (FIGS. 9 and 10) of an electrical connector, generally designated 13. The insulating housing has an elongated slot 16 on each opposite side of a central partition 12*a* of the housing for receiving the complementary terminals of a mating electrical connector. Side walls 15 of the housing have a plurality of mounting holes 14 outside slot 16.

As seen best in FIG. 1, each terminal 1 is generally U-shaped and defines a contact arm 2 integrally joined to a rigid base 3 by a curved juncture portion 4, with a retention arm 6 generally parallel to contact arm 2. In essence, contact arm 2 and retention arm 6 form the legs of the U-shaped terminal, with base 3 forming the bight portion of the U-shape. A contact portion 5 projects from contact arm 2 toward retention arm 6. A retention tooth or barb 7 projects from the outside of retention arm 6. A solder tail 8 projects from base 3 generally parallel thereto for soldering to a conductive circuit trace on a printed circuit board (not shown).

With terminal 1 stamped of sheet metal material, the terminal, in essence, is defined by opposite sides and peripheral edges. The opposite sides are the major planes of the terminal as defined by the opposite planar surfaces of the sheet metal material from which the terminal is stamped. The edges are the stamped edges which define the precise peripheral shape of the terminal.

In one example, the thickness of the sheet metal from which the terminal is stamped and thus generally between the sides of the terminal is 0.2 mm. Referring to FIG. 1, the width "A" between the edges of contact arm 2 is 0.23 mm, and the width "B" between the edges of rigid base 3 is 0.23 mm. The width of curved juncture portion 4 at any point between its opposite edges is 0.18 mm. Therefore, it can be understood that both the contact arm 2 and the base 3 are wider between their respective edges than juncture portion 4. In addition, the width of both the contact arm 2 and the base 3 is wider than the thickness of the sheet metal material, whereas the width of juncture portion 4 is less than the thickness of the sheet metal material. With these parameters, a considerably improved flexibility is provided for contact arm 2 without either lengthening the contact arm or reducing the thickness of the sheet metal material.

A further advantage is gained by dimensioning the width of both contact arm 2 and base 3 wider than curved portion 4. When stamping the shape of the terminal 1 out of the sheet metal material, a narrow section such as curved portion 4 may have a tendency to twist. However, since contact arm 2 and base 3 are wide enough to resist this twisting and are located on opposite sides of the curved portion 4, curved portion 4 is unable to twist. In other words, since the ends of curved portion 4 are fixed to the contact arm 2 and base 3, respectively, it is very difficult for curved portion 4 to twist without also twisting either contact arm 2 or base 3. This helps to maintain the desired position of contact portion 5.

Figure 2:
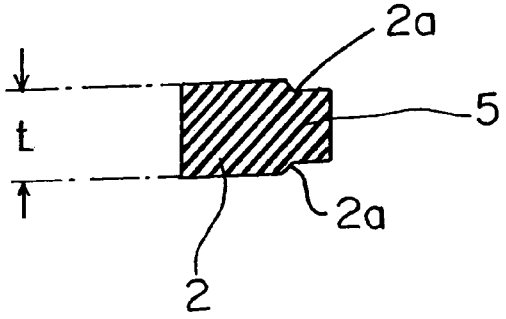
FIG. 2 is an enlarged section taken generally along line E—E in FIG. 1.
Figure 3:
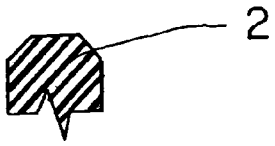
FIG. 3 is an enlarged section taken generally along line F—F in FIG. 1.
Figure 4:
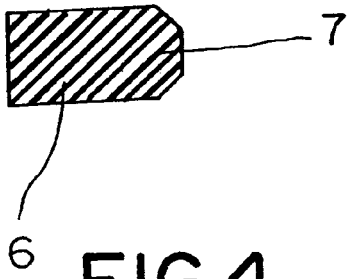
FIG. 4 is an enlarged section taken generally along line G—G in FIG. 1.
Figure 5:
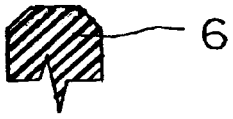
FIG. 5 is an enlarged section taken generally along line H—H in FIG. 1.
Figure 6:
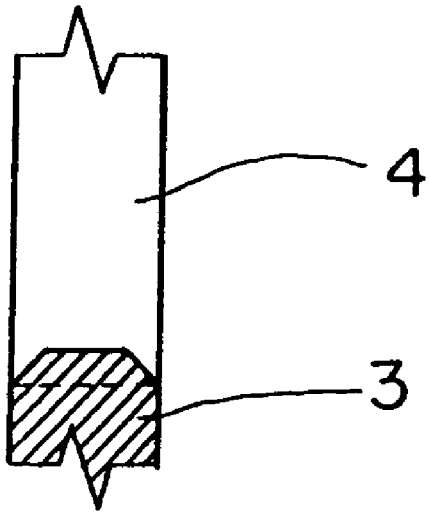
FIG. 6 is an enlarged section taken generally along line I—I in FIG. 1.
Figure 7:
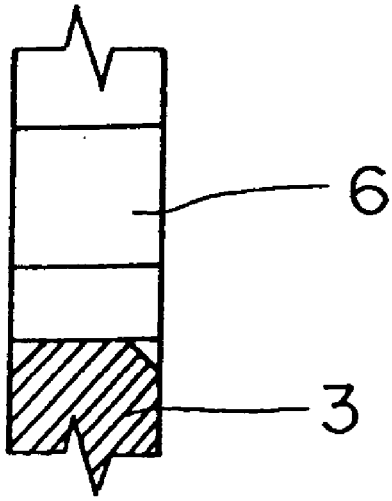
FIG. 7 is an enlarged section taken generally along line J—J in FIG. 1.

FIG. 2 shows a feature of the invention wherein the thickness of contact portion 5 is made less than the thickness of the sheet metal material of contact arm 2. Specifically, the contact arm is stepped, as at 2*a*, on opposite sides thereof at the contact portion so that the thickness of the contact portion is less than the given thickness of the contact arm, as shown. This considerably reduces the possibility that the contact portion might engage the wrong complementary blade terminal of the mating connector.

FIGS. 3–7 show that various lead-in edges of the terminal have angled or chamfered corners to facilitate inserting the terminals into their respective cavities in connector housing 12. In other words, terminal 1 is inserted into its respective cavity in the housing in the direction of arrow "X" (FIG. 1). It can be seen that the major leading edges of the terminal in the "X" direction are chamfered as shown in FIGS. 3–7.

Figure 8:
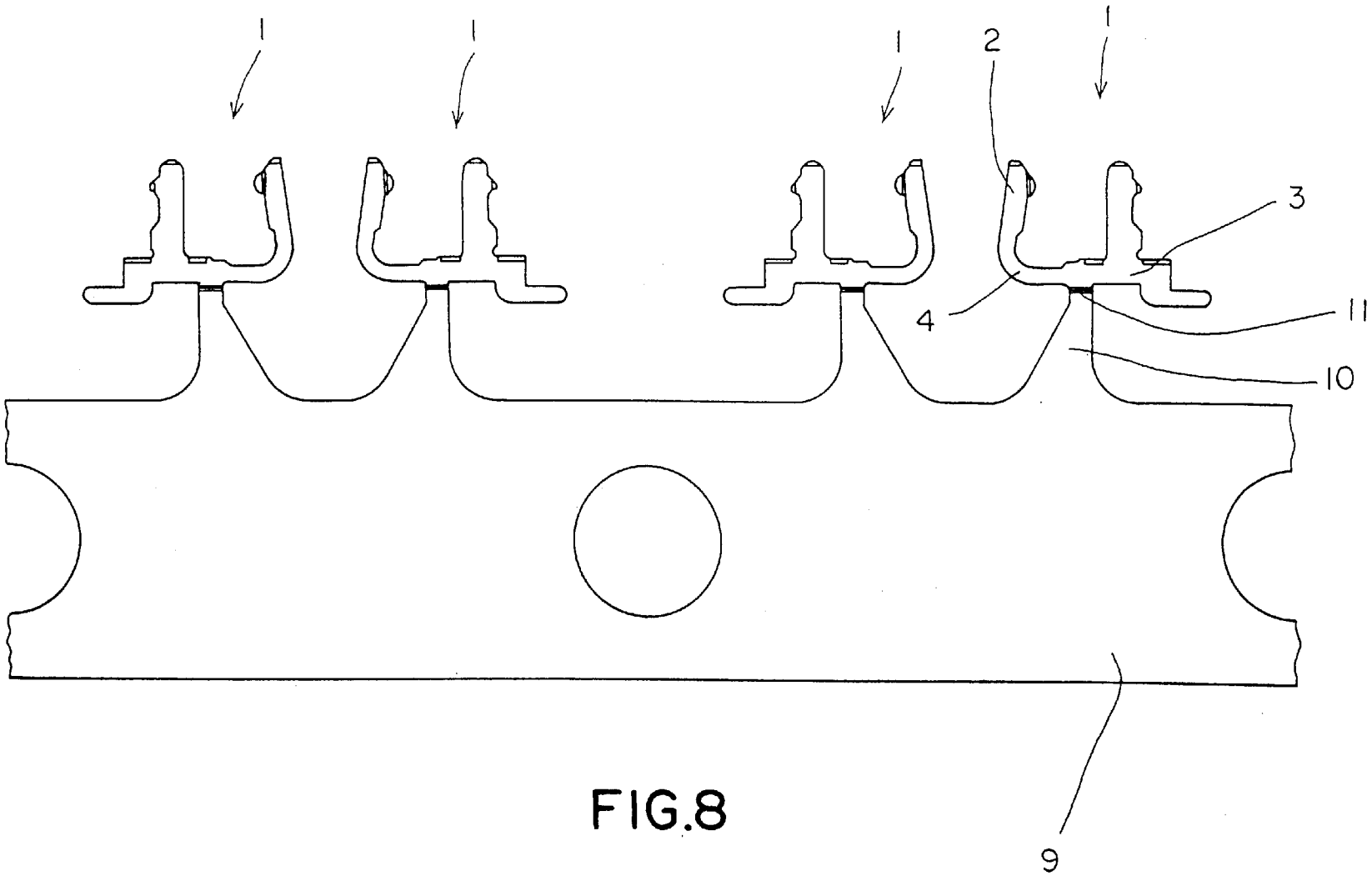
FIG. 8 is a plan view of a plurality of terminals joined to a carrier strip as during manufacture thereof.

FIG. 8 shows a series of terminals 1 having been stamped from sheet metal material (0.2 mm thick) with the terminals still joined to a carrier strip 9 by respective webs 10. Each web 10 has a stamped notch 11 made immediately adjacent base 3 of the respective terminal to facilitate separating the terminal from carrier strip 9 and the web.

Figure 9:
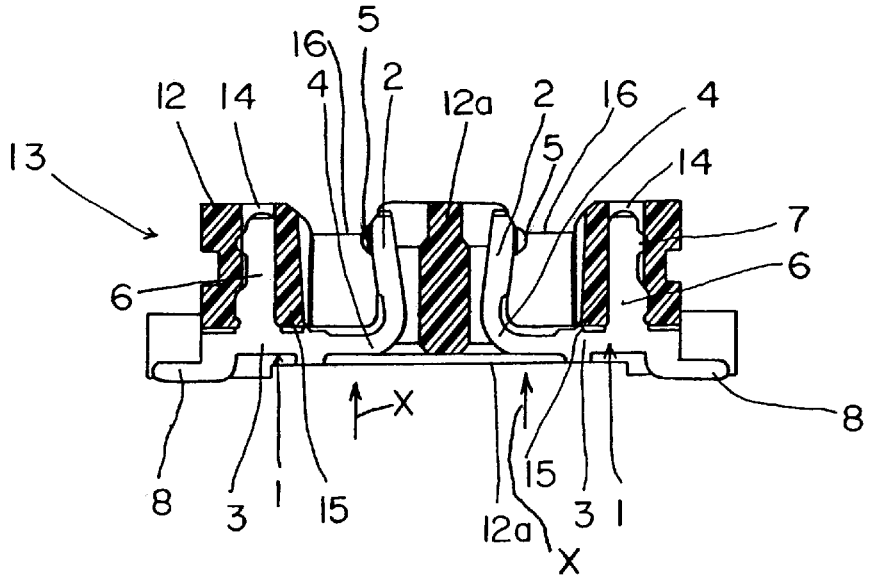
FIG. 9 is an enlarged section taken generally along line K—K in FIG. 10.
Figure 10:
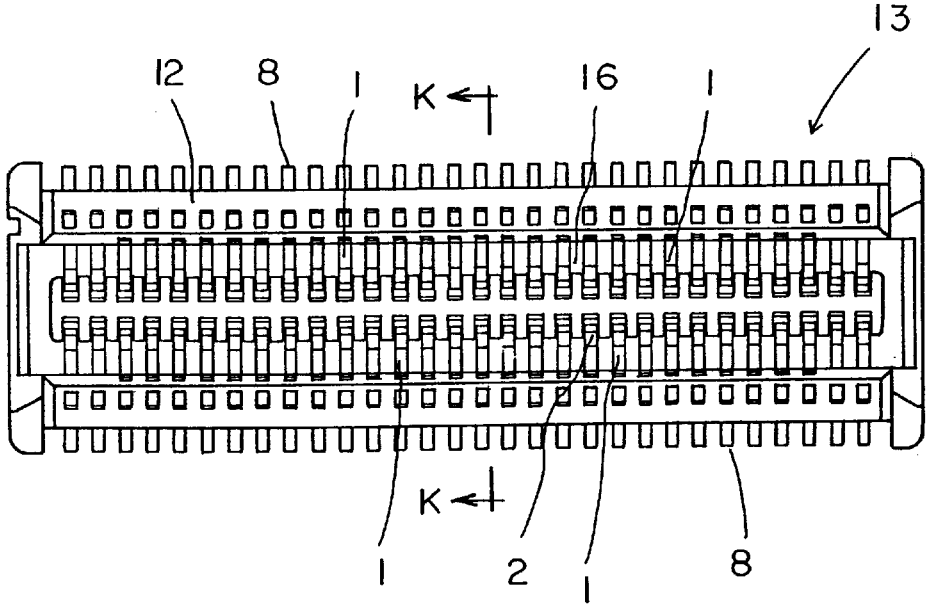
FIG. 10 is a top plan view of an electrical connector having a plurality of the terminals mounted therein.

FIGS. 9 and 10 show a plurality of terminals 1 mounted in housing 12 of connector 13. The terminals are inserted into the housing in the "X" direction as described above. During insertion, retention arms 6 of the terminals are pushed into mounting holes 14 in side walls 15 of the housing. When fully inserted, the bases 3 of the terminals abut against the bottoms of side walls 15. Also, when fully inserted, contact portions 5 of flexible contact arms 2 project into slots 16 for engaging the appropriate complementary blade terminals of the mating connector. Reduced cross-sectional juncture portions 4 of the terminals provide improved resiliency for contact arms 2, while contact portions 5 still provide a good positive engagement with the complementary mating terminals. The terminals are mounted in the housing at spaced, generally parallel intervals (e.g. 0.5 mm). The terminals are prevented from backing out of the housing by the interference fit of retention teeth 7 biting into the plastic material of the housing within mounting holes 14.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for mating with a complementary component, said connector comprising:

an insulative housing having a receptacle for receiving a portion of said complementary component and a plurality of terminal receiving cavities for receiving terminals therein, a plurality of generally planar conductive terminals stamped from sheet metal material of a predetermined thickness, each terminal having a predetermined thickness generally equal to the thickness of the sheet metal material from which it is stamped and being mounted in one of said cavities, the terminal including a generally rigid base having a base width parallel to the plane of said terminal, a solder tail extending from said base, a retention section for securing the terminal within said housing and an L-shaped contact portion extending from said base, said L-shaped contact portion including first and second legs connected at a juncture portion, said first leg having a first width parallel to the plane of said terminal and including a contact portion for contacting a conductive portion of said complementary component, said second leg extending from said base, said juncture portion having a juncture width parallel to the plane of said terminal, said base width and said first width being greater than said thickness of said terminal and said juncture width being less than said thickness of said terminal.

2. The electrical connector of claim 1 wherein said housing is elongated includes a pair of component receiving slots extending generally parallel to a longitudinal axis of said housing and a plurality of terminal receiving cavities with terminals therein adjacent each slot, said contact portions of said terminals projecting into said slots.

3. The electrical connector of claim 1 wherein said retention section comprises a generally rigid retention arm extending from said base and said contact portion projects toward the retention arm.

4. The electrical connector of claim 1 wherein sides of the contact arm at said contact portion being stepped so that the thickness of the contact portion is less than said predetermined thickness of the terminal.

5. An electrical terminal for mounting in a circuit board mounted electrical connector requiring a fine pitch, the terminal being adapted for contacting one of a plurality of closely spaced terminals of a complementary mating terminal, the electrical terminal being generally U-shaped and comprising: a generally rigid retention arm and a flexible contact arm joined to the retention arm by a generally rigid base, the contact arm having a given thickness in a direction generally perpendicular to the plane of the U-shaped terminal and a contact portion projecting toward the retention arm for engaging said one terminal, sides of the contact arm at said projecting contact portion being stepped so that the thickness of the contact portion is less than said given thickness of the contact arm.

6. The electrical terminal of claim 5 wherein said contact arm has a width in a direction generally parallel to the plane of the U-shaped terminal that is greater than said given thickness of the contact arm.

7. The electrical terminal of claim 6 wherein said base has a width in a direction generally parallel to the plane of the U-shaped terminal that is greater than said given thickness of the contact arm.

8. The electrical terminal of claim 7 wherein said contact arm is joined to the base at a juncture which has a width in a direction generally parallel to the plane of the U-shaped terminal that is less than said given thickness of the contact arm.

9. The electrical terminal of claim 8 wherein said terminal is stamped from sheet metal material to define sides and edges, with the projecting contact portion of the contact arm being at an edge of the stamped sheet metal material.

10. A conductive terminal for mounting in an electrical connector housing, said terminal comprising:

a generally planar structure stamped from sheet metal material of a predetermined thickness and having a predetermined thickness generally equal to the thickness of the sheet metal material from which it is stamped, a generally rigid base having a base width parallel to the plane of said terminal, a solder tail extending from said base, a retention section for securing the terminal within said housing and an L-shaped contact portion extending from said base, said L-shaped contact portion including first and second legs connected at a juncture portion, said first leg having a first width parallel to the plane of said terminal and including a contact portion for contacting a conductive portion of a complementary mating component, said second leg extending from said base, said juncture portion having a juncture width parallel to the plane of said terminal, said base width and said first width being greater than said thickness of said terminal and said juncture width being less than said thickness of said terminal and sides of the contact arm at said contact portion being stepped so that the thickness of the contact portion is less than said predetermined thickness of the terminal.

11. The electrical connector of claim 10 wherein said retention section comprises a generally rigid retention arm extending from said base and said contact portion projects toward the retention arm.

* * * * *